US005080733A

United States Patent [19]

Deresh

[11] Patent Number: 5,080,733

[45] Date of Patent: Jan. 14, 1992

[54] METHOD FOR PRODUCING CHROMATE CONVERSION COATINGS

[75] Inventor: Ley Deresh, Waterbury, Conn.

[73] Assignee: MacDermid, Incorporated, Waterbury, Conn.

[21] Appl. No.: 506,699

[22] Filed: Apr. 9, 1990

[51] Int. Cl.[5] ..... C23C 22/24

[52] U.S. Cl. ..... 148/266; 148/267

[58] Field of Search ..... 148/166, 266, 267

[56] References Cited

U.S. PATENT DOCUMENTS 2,887,418 5/1959 Whitby ..... 148/266

2,998,361 8/1961 Kitamura ..... 148/266

OTHER PUBLICATIONS

Eppensteiner, F. W. and Jenkins, M. R., "Chromate Conversion Coatings", pp. 433 et seq.; Metal Finishing Guidebook (1990).

*Primary Examiner*—Sam Silverberg

*Attorney, Agent, or Firm*—St. Onge Steward Johnston & Reens

[57] ABSTRACT

Chromate conversion coatings of improved corrosion resistance are produced through use of chromate conversion coating compositions containing alkane sulfonic acid.

12 Claims, No Drawings

METHOD FOR PRODUCING CHROMATE CONVERSION COATINGS

BACKGROUND OF THE INVENTION

The present invention relates to chromate conversion coatings and, more particularly, to compositions and processes for producing chromate conversion coatings on metal surfaces so as to afford corrosion resistance to the metal surfaces.

Chromate conversion coatings are well-known in the metal finishing art and have long been used to provide corrosion resistance to articles either made from, or coated with, metals such as zinc, cadmium, zinc-cobalt alloys, and the like, and also may serve to provide a desired decorative finish to the article. The coatings are referred to as conversion coatings because the treatment brings about reaction at the metal surface so as to convert the metal surface to a superficial layer containing a complex mixture of chromium compounds.

Chromate conversion coatings can, by variation in composition of the solution from which they are applied and to some extent variation in the conditions of treatment, be applied to the metal surface in a variety of coating (or film) thicknesses, with the degree of corrosion resistance afforded being generally proportional to the coating thickness. Generally speaking, the chromate coating is very thin, ranging, for example, from about one to about 50 microinches. As is well-known in the art, the generally thin nature of these coatings, coupled with the generally increasing content of chromium associated with increasing coating thickness, enables the chromate coatings of varying thickness to be broadly characterized on the basis of color. Thus, for example, where the metal surface is zinc, cadmium or zinc-cobalt alloy, chromate conversion coatings, from thinnest to thickest, can be broadly characterized as blue-bright, iridescent yellow, brown, bronze, olive-drab and black.

The essential components of a composition used to treat a metal surface for provision of a chromate conversion coating thereon are, in aqueous solution, a source of hexavalent and/or trivalent chromium ions, acid, and a source or sources of so-called activator anions, generally from among the group of acetate, formate, sulfate, chloride, fluoride, nitrate, phosphate and sulfamate ions, which generally determine the character, rate of formation and properties of the chromate film, all as well known in the art. Generally speaking, the formation of chromate conversion coatings on metal surfaces involves immersion of the article in the composition for the time required to produce the desired coating, although treatments involving spraying, brushing, swabbing or even electrolytic techniques are also known and used.

A general aim of research and development efforts in chromate conversion coatings is to provide compositions and coatings which will afford the best possible corrosion protection to the metal surface in the thinnest possible coating, since in this way increased costeffectiveness can be obtained and, in situations where particular coating color is desired, improved corrosion protection in that coating color can be obtained. Also, it is known that for particular metal surfaces, certain chromate coatings of desired color are not acceptably attainable. This is the case, for example, for iridescent yellow chromate coatings on zinc-cobalt alloy surfaces, where prior art yellow chromate coating compositions generally result instead in grayish films (dark gray recesses on the zinc-cobalt surface).

SUMMARY OF THE INVENTION

It is a primary object of the present invention to provide compositions for the treatment of metal surfaces to provide chromate conversion coatings thereon having improved corrosion protection properties, and to provide methods for utilizing such compositions.

Another object of the invention is to provide compositions for producing chromate conversion coatings which, relative to known chromate conversion coatings of equivalent film thickness, exhibit improved corrosion protection.

Yet another specific object of the invention is to provide compositions for providing iridescent yellow chromate conversion coatings on articles made from, or coated with, zinc-cobalt alloy.

The foregoing and other objects are achieved in the present invention by the inclusion in a chromate conversion coating composition of an alkane sulfonic acid, preferably methane sulfonic acid, in an amount, preferably between about 1 g/l to about 50 g/l, effective to produce a chromate conversion coating on metal surfaces which affords improved corrosion protection as compared to chromate conversion coatings produced by compositions which do not include alkane sulfonic acid.

According to the invention, then, aqueous compositions are provided which comprise a source of hexavalent and/or trivalent chromium, alkane sulfonic acid, and one or more sources of activator anions, all in amounts effective to produce chromate conversion coatings of desired thickness and/or color on a metal surface brought into contact with the composition, particularly surfaces of zinc, cadmium and zinc-cobalt alloys. Generally, except for the inclusion of alkane sulfonic acid, the compositions make use of concentrations of hexavalent chromium, and types and concentrations of activator anions, traditionally and conventionally employed in the art to obtain chromate conversion films of particular thickness and/or color on particular metal surfaces, with the inclusion of alkane sulfonic acid imparting to those conventional compositions the ability to produce chromate conversion coatings of improved corrosion protection. Thus, the invention is easily and readily practiced by those skilled in this art by mere inclusion in conventional compositions of alkane sulfonic acid, with particular levels of inclusion being readily determinable from the guidelines presented herein and whatever minimal experimentation may be necessary to take into account particular features of any particular conventional composition, e.g., particular sources and/or concentrations of hexavalent chromium and/or activator anions.

Inasmuch as compositions for producing chromate conversion coatings required acid (typically, sulfuric or nitric acid in the known compositions), the invention herein primarily contemplates the use of alkane sulfonic acid as a substitute for these traditionally employed acids, but advantage also can be obtained through utilization of the alkane sulfonic acid either in addition to, or partial replacement of, these traditionally employed acids. Although not wishing to be bound by theory as such, it appears as if the alkane sulfonic acid improves the activation of the metal surfaces in contact with the chromate conversion coating composition, and desirably decreases the rate of dissolution of the formed chromate film. It will be understood, of course, that even when the alkane sulfonic acid is used as a replacement for the traditionally employed acids, the composition may still contain other acids simply as sources of the required activator anions (e.g., formic acid for formate anion, acetic acid for acetate anion, phosphoric acid for phosphate anion, etc.). Accordingly, the primary criterion according to the invention is the presence of alkane sulfonic acid, typically from about 1 g/l to about 50 g/l, in an aqueous chromate conversion coating composition containing suitable amounts of hexavalent and/or trivalent chromium and activator anions for any particular application.

According to the invention, chromate conversion coatings can be produced, using compositions containing alkane sulfonic acid, in any of the desired coating thicknesses and color, e.g., ranging from thin blue-bright films to thicker black films, with any such coating exhibiting improved corrosion protection relative to those produced by corresponding compositions formulated without alkane sulfonic acid. Also, as previously noted, the compositions herein enable production of coatings not heretofore satisfactorily attainable in the art, such as the yellow iridescent coating of zinc-cobalt alloy surfaces.

DETAILED DESCRIPTION OF THE INVENTION

As noted, the present invention is applicable to the provision of chromate conversion coatings on articles made from, or coated with (e.g., by electroplating, mechanical plating or other technique), those metals traditionally treated in this manner, most notably zinc and cadmium and alloys thereof, particularly zinc-cobalt alloys. The composition of the present invention is particularly adapted for provision of chromate conversion coatings by immersion of the article in the composition, typically at solution temperatures of from about 20° C. to about 30° C., for a relatively brief period of time, depending on the particular thickness coating and other factors, ranging from as low as a few seconds. The compositions can also be employed in spraying, brushing or swabbing techniques, and can also be adapted for electrolytic treatment if desired. As is known in the art, the treated articles can be subjected to drying procedures to hasten the setting of the chromate film on the article.

The hexavalent chromium ion can be provided by any suitable composition-soluble source, with chromium oxide ($CrO_3$) being a readily available and preferred source. Other sources may, however, be employed, alone or in combination, such as $K_2Cr_2O_7$, $Na_2Cr_2O_7$, $K_2CrO_4$, $Na_2CrO_4$, and the like.

Typically, the concentration of the hexavalent chromium in the aqueous composition will range from about 0.1 to about 50 g/l, with the lower concentrations typically employed for thin coatings and the higher levels for thick coatings, with specific concentrations depending upon the particular coating desired and, to a degree, the type and concentration of other components (e.g., activator anions) in the system. For example, thin blue-bright coatings on zinc, cadmium or zinc-cobalt alloy typically will require a hexavalent chromium concentration of from 0.1 g/l to about 0.5 g/l, while concentrations for iridescent yellow can range from 1.5 g/l to about 5 g/l, and concentrations for the thicker olive-drab and black coatings can range from 10 g/l to about 20 g/l.

Trivalent chromium ion also can be present in the composition, via any suitable source, depending upon needs for any particular desired coating.

The activator anions generally will be chosen from among the earlier-noted acetate, formate, sulfate, chloride, fluoride, nitrate, phosphate and sulfamate ions, as provided by any suitable source consistent with the overall composition. The art is well-versed in the choice of particular anions and the concentrations thereof for producing chromate conversion coatings of desired thickness and properties, and indeed the choice is fairly wide-ranging. The source of the activator anion may be chosen so as to provide in the composition not only the desired anion, but also a particular cation or cations having particular utility in the provision of specific chromate conversion coatings (e.g., $Ag^+$ for inclusion in compositions for providing thick black chromate coatings).

In terms of the required functional acid, the alkane sulfonic acid can be solely relied upon in this regard, or can be employed with other such functional acids as have been used in the art (e.g., sulfuric acid, nitric acid). Generally, the desired operating pH of the composition is in the range of from about 1.5 to about 3, and the acid component will be chosen, and used in an amount, sufficient to provide this hydrogen ion concentration, with the proviso, of course, that the alkane sulfonic acid in any event be present in an amount effective to provide the improved corrosion protection.

As noted, the typical concentration of alkane sulfonic acid in the composition will be from about 1 g/l to about 50 g/l, more preferably from about 5 g/l to about 30 g/l, and most preferably from about 10 g/l to about 25 g/l. These concentrations are given relative to the alkane sulfonic acid per se; as is known, however, the sulfonic acids (e.g., methane sulfonic acid) are widely available commercially as 70% by volume aqueous solutions, and as such use of the acid in that form will be at concentrations suitable for providing the requisite concentration of the acid per se.

The alkane sulfonic acids correspond to the formula $R\text{-}SO_3H$, with R being a lower alkyl, typically methyl or ethyl, and most preferably methyl, i.e., methane sulfonic acid.

The corrosion protection afforded by the chromate conversion coating is conventionally measured in accelerated corrosion tests, i.e., hours to white corrosion in 5% neutral salt spray according to ASTM B-117. Corrosion protection also can be measured, at the very least comparatively, in spot tests, e.g., 5% lead acetate drop test to the appearance of the characteristic black spot. As will be seen in the Examples herein, the increase in corrosion protection afforded by the compositions of the invention employing alkane sulfonic acid is surprising and substantial, typically at least about twice that attained with compositions not including the sulfonic acid.

The following examples are provided in further description of the invention.

EXAMPLE I

Steel parts were provided with a bright zinc electroplated coating of about 7–8 microns thickness using a weak acid chloride zinc electroplating bath, and were bright-dipped in 0.5% nitric acid for five seconds.

One batch of the plated parts was treated with an aqueous chromating composition according to the invention, containing:

| | |
|---|---|
| $NaNO_3$ | 3.5 g/l |
| $NaHF_2$ | 1.3 g/l |
| $Na_2CrO_4$ | 0.65 g/l |
| Methane Sulfonic Acid | 10 g/l |

while another batch of the parts was treated with an identical aqueous composition except for replacement of the methane sulfonic acid (MSA) with sulfuric acid. For each treatment, the solution temperature was 20°-25° C. and the immersion time 20 to 30 seconds, and in each case a blue-bright chromate conversion coating was produced on the parts.

In 5% lead acetate drop test, the parts chromated using the methane sulfonic acid-containing composition of the invention did not exhibit the black spot until about 2-3 minutes, while the parts chromated with the composition not containing MSA exhibited black spot formation in 5-10 seconds.

In 5% neutral salt spray tests, the parts treated with the MSA-containing composition stayed 48 to 120 hours before the appearance of white rust, as compared to 8 to 24 hours for the parts treated with the non-MSA composition.

EXAMPLE II

Zinc-plated panels were divided into two batches, one treated with an aqueous composition (pH 1.6) according to the invention, containing:

| | |
|---|---|
| $CrO_3$ | 4 g/l |
| $MgSO_4$ | 0.8 g/l |
| $CH_3COOH$ | 1.5 g/l |
| MSA | 2 g/l |

and the other batch treated with the identical aqueous composition except for replacement of MSA with nitric acid. Solution temperature of 20° C. and immersion time of 30 seconds were used to produce an iridescent yellow chromate conversion coating on the zinc-plated panels.

In 5% neutral salt spray test, white rust appeared after 264 to 360 hours for the panels treated with the MSA-containing composition, as compared to 96 to 144 hours for the panels chromated using the nitric acid-containing composition.

EXAMPLE III

Panels plated with zinc-cobalt were treated with the two compositions set forth in Example II (i.e., the methane sulfonic acid-containing composition, and the composition in which the MSA is replaced with nitric acid), and in accordance with the procedures of Example II. The MSA-containing composition produced an iridescent yellow chromate conversion coated on the zinc-cobalt surfaces, while the nitric acid-containing composition did not produce a chromate film.

EXAMPLE IV

Panels plated with zinc-cobalt to a thickness of 7.5 microns were chromated according to Example II using the MSA-containing composition, and produced a uniform iridescent film which, in 5% neutral salt spray, did not exhibit red rust until after 750 hours.

Identically plated panels were chromated in a hot conventional iridescent chromate aqueous solution (pH 1.6) containing:

| | |
|---|---|
| $CrO_3$ | 2 g/l |
| $Na_2Cr_2O_7$ | 15 g/l |
| $Cr_2(SO_4)_3$ | 3 g/l |
| $ZnSO_4$ | 1 g/l |

according to recommended techniques (solution temperature, 50° C.; immersion time, 30 seconds). Rather than an iridescent film, a grayish film resulted, and in 5% neutral salt spray, red rust appeared at 650 hours.

EXAMPLE V

Uniform olive-drab coatings were formed on zinc-plated panels using an aqueous composition (pH 1-2) containing:

| | |
|---|---|
| $CrO_3$ | 13 g/l |
| $Na_2Cr_2O_7$ | 13 g/l |
| HCOOH | 25 g/l |
| MSA | 25 g/l |

using a solution temperature of 20°-25° C. and an immersion time of 20 to 40 seconds.

EXAMPLE VI

A uniform black chromate coating was formed on zinc-plated panels using an aqueous composition (pH 1.7) containing:

| | |
|---|---|
| $CrO_3$ | 15 g/l |
| $Na_2SO_4$ | 5 g/l |
| $H_3PO_4$ | 2 g/l |
| $AgNO_3$ | 0.7 g/l |
| MSA | 10 g/l |

using a solution temperature of 20° C. and an immersion time of 30 seconds.

The foregoing examples and description are provided in illustration of the invention and particular embodiments thereof, and are not intended to be restrictive of the scope of the invention except as set forth in the appended claims.

What is claimed is:

1. In a non-electrolytic process for providing a chromate conversion coating on a metal surface, wherein said metal surface is contacted with a composition for producing said chromate conversion coating for a time effective to produce said chromate conversion coating on said metal surface, and wherein said composition comprises an aqueous solution comprised of a source of hexavalent and/or trivalent chromium, acid, and a source of at least one activator anion, each in amounts effective to produce on said metal surface a protective chromate conversion coating when said metal surface is contacted with said composition, the improvement comprising including in said composition alkane sulfonic acid in an amount effective to increase the corrosion resistance afforded by said chromate conversion coating as compared to a chromate conversion coating formed on said metal surface from a composition without said alkane sulfonic acid.

2. A process according to claim 1 wherein said metal surface is selected from the group consisting of zinc, cadmium, and zinc-cobalt alloy.

3. A process according to claim 2 wherein said alkane sulfonic acid is present in said composition in an amount of from about 1 b/l to about 50 g/l.

4. A process according to claim 3 wherein said alkane sulfonic acid is methane sulfonic acid.

5. A process according to claim 1 wherein said activator anion is selected from the group consisting of acetate, formate, sulfate, chloride, fluoride, nitrate, phosphate and sulfamate anions, and mixtures thereof.

6. A process according to claim 1 wherein said metal surface is zinc-cobalt alloy, and wherein said chromate conversion coating is an iridescent yellow chromate coating.

7. A process according to claim 2 wherein said chromate conversion coating is selected from the group consisting of clear-bright, blue-bright, iridescent yellow, brown, bronze, olive-drab and black chromate conversion coatings.

8. In a non-electrolytic process for providing a chromate conversion coating on a metal surface selected from the group consisting of zinc, cadmium and zinc-cobalt alloy, wherein said metal surface is contacted with a composition for producing said chromate conversion coating for a time effective to produce said chromate conversion coating on said metal surface, and wherein said composition comprises an aqueous solution comprised of a source of hexavalent and/or trivalent chromium, acid, and a source of at least one activator anion, each in amounts effective to produce on said metal surface a protective chromate conversion coating when said metal surface is contacted with said composition, the improvement comprising including in said composition from about 1 to about 50 g/l of alkane sulfonic acid to increase the corrosion resistance afforded by said chromate conversion coating as compared to a chromate conversion coating formed on said metal surfaces from a composition without said alkane sulfonic acid.

9. A process according to claim 8 wherein said alkane sulfonic acid is methane sulfonic acid.

10. A process according to claim 8 wherein said activator anion is selected from the group consisting of acetate, formate, sulfate, chloride, fluoride, nitrate, phosphate and sulfamate anions, and mixtures thereof.

11. A process according to claim 8 wherein said chromate conversion coating is selected from the group consisting of clear-bright, blue-bright, iridescent yellow, brown, bronze, olive-drab and black chromate conversion coating.

12. In a non-electrolytic process for providing a chromate conversion coating on a metal surface selected from the group consisting of zinc, cadmium and zinc-cobalt alloy, wherein said metal surface is contacted with a composition for producing said chromate conversion coating for a time effective to produce said chromate conversion coating on said metal surface, and wherein said composition comprises an aqueous solution comprised of a source of hexavalent and/or trivalent chromium, acid, and a source of at least one activator anion selected from the group consisting of acetate, formate, sulfate, chloride, fluoride, nitrate, phosphate and sulfamate anions, and mixtures thereof, each in amounts effective to produce on said metal surface a protective chromate conversion coating when said metal surface is contacted with said composition, the improvement comprising including in said composition from about 1 to about 50 g/l of methane sulfonic acid to increase the corrosion resistance afforded by said chromate conversion coating as compared to a chromate conversion coating formed on said metal surface from a composition without said methane sulfonic acid.

* * * * *